United States Patent [19]

Schaefer

[11] Patent Number: 4,595,622

[45] Date of Patent: Jun. 17, 1986

[54] FELTING

[75] Inventor: Philipp Schaefer, Hanover, Fed. Rep. of Germany

[73] Assignee: J. H. Bemecke GmbH, Fed. Rep. of Germany

[21] Appl. No.: 708,678

[22] Filed: Mar. 6, 1985

[30] Foreign Application Priority Data

Mar. 7, 1984 [DE] Fed. Rep. of Germany ... 8406900[U]

[51] Int. Cl.[4] ..... B32B 3/10; B32B 3/28; B32B 5/16

[52] U.S. Cl. ..... 428/173; 428/171; 428/206; 428/281; 428/327; 428/343; 428/355

[58] Field of Search ..... 428/171, 173, 156, 281, 428/327, 343, 355, 212, 147, 206, 913

[56] References Cited

U.S. PATENT DOCUMENTS

| | | | |
|---|---|---|---|
| 2,250,482 | 7/1941 | Harshberger | 428/355 |
| 3,963,847 | 6/1976 | Norgard | 428/206 |
| 4,250,136 | 2/1981 | Rex | 428/327 |

FOREIGN PATENT DOCUMENTS

| | | | |
|---|---|---|---|
| 55-111252 | 8/1980 | Japan | 428/173 |

*Primary Examiner*—Paul J. Thibodeau

*Attorney, Agent, or Firm*—Allegretti, Newitt, Witcoff & McAndrews, Ltd.

[57] ABSTRACT

A felting of synthetic fibers having an embossed pattern that forms depressions in at least one surface of the felting is disclosed. The surface of the felting with depressions contains, in at least the area of the depressions, a layer of small hollow spheres that are bonded to one another and to the felting by means of a binding agent. The layer of hollow spheres fills up, at least partially, the depressions in the surface of the felting produced by embossing. This reinforces and strengthens the thinner areas of felting in the vicinity of these depressions. When the reinforced felting is applied to a shoe upper, for example, the resulting upper has improved stiffness and strength. Furthermore, the excessive penetration of adhesive into the felting, which can cause a spotty or uneven appearance of the reinforced upper, is prevented. Resistance to splitting and separating is likewise improved.

12 Claims, 1 Drawing Figure

FELTING

BACKGROUND OF THE INVENTION

1. Field of the Invention

The present invention relates to embossed felting.

2. Description of the Prior Art

Embossed feltings are often used as linings for shoes, particularly sport shoes that have leather uppers. The feltings serve to strengthen and improve the overall stability of the leather upper. Feltings used for this purpose must also be permeable to water vapor and air.

A known embossed felting is provided on its back side with a heat-activated adhesive. This felting is disadvantageous in that the heat-activated adhesive, which is applied under conditions of heat and pressure, has a tendency to penetrate so deeply into the felting that it is lost for adhesion purposes. Also, there is the risk of the adhesive penetrating so deeply, especially in thin spots in the felting, that the felting is rendered more transparent there than at thicker places. This causes the different colored background to which the felting is glued, e.g., a leather or synthetic leather upper, to show through the felting and produce an undesirable spotty or uneven appearance.

SUMMARY OF THE INVENTION

It is an object of the present invention to avoid the drawbacks of the prior art by creating an embossed felting capable of strengthening and stabilizing a shoe upper when applied to the back side thereof.

It is another object of the present invention to provide an embossed felting capable of compensating for weak places in the upper without giving rise to an uneven or spotty appearance after adhesive bonding.

It is a further object of the present invention to provide an embossed felting that is flexible, light, pliant and permeable to water vapor and air.

It is a specific object of the present invention to provide an improved embossed felting wherein the depressions in at least one side of the felting are filled in to some extent by a plurality of hollow spheres. The spheres are then bonded together and to the felting by a binding agent.

One purpose of the layer of hollow spheres provided by the present invention is to fill in, at least partially, the depressions formed by embossing, thereby reinforcing the thinner areas of felting in the area of these depressions. This reinforcement leads not only to enchanced firmness and stiffness in the shoe upper to which the felting is applied, but also prevents the penetration of adhesive into the felting, especially where a thermoplastic adhesive is contemplated. This prevents the different-colored background, e.g., the upper, from showing through in an uneven manner. In addition, the resistance of the upper to splitting and separating is improved.

Further objects and embodiments of the present invention will be made clear in the following description of the preferred embodiments and claims.

DESCRIPTION OF THE PREFERRED EMBODIMENTS

Figure 1:
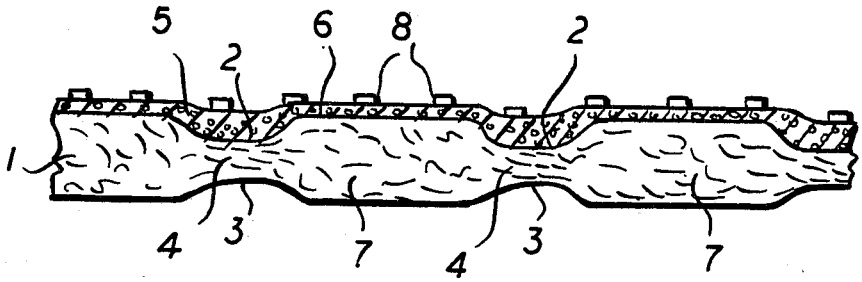
FIG. 1 shows a partial cross-sectional view of a preferred embodient of the present invention.

The layer of small hollow sphere can wholly or partially fill in the depressions in the surface of the felting. It is also possible to provide a layer of spheres on both sides of the felting, especially where there are depressions on both surfaces. In the raised areas between the depressions, the layer of small hollow spheres can be very thin and, in fact, can be completely omitted. However, it is desirably advantageous to provide at least some spheres in these raised areas.

In order to insure the water vapor and air permeability of the layer of small hollow spheres, it is advantageous to use a binding agent that provides interstitial spaces throughout. This can be achieved by appropriately apportioning the amount of the binding agent used. If the layer of small hollow spheres is additionally provided with a layer of adhesive, then it is advantageous for this adhesive layer to also have interstitial spaces.

An especially preferred embodiment of the present invention comprises the use of hollow spheres made of thermoplastic material. This makes it possible to deform the small thermoplastic hollow spheres by means of a hot smooth cylinder and, thus, to smooth the surface of the felting. In order to prevent the felting itself from being deformed, especially if the felting itself is thermoplastic, it is preferable that the melting point of the thermoplastic hollow spheres be lower than that of the felting. This allows the smoothing step to be carried out below the melting point of the felting.

Referring to FIG. 1, a preferred embodiment of the present invention includes a felting 1 made from thermoplastic, polypropylene fibers that has depressions 2 and 3 on both sides. These depressions are formed by hot embossing, which is necessary to join or weld the thermoplastic fibers together. In the areas of the depressions 2 and 3, therefore, thin spots 4 are formed in the felting 1.

On the surface of the felting 1 having depression 2, a layer of small hollow spheres 5 made from one or more vinyl chloride copolymers is provided. The hollow spheres 5 are bonded by means of a binding agent to one another and to the felting such that free continuous interstitial spaces are formed among the small hollow spheres 5. Suitable binding agents include semi-solid plastic dispersions or emulsions, preferably containing polyethylene, polyisobutylene, polyvinyl acetate, polyurethane, polybutadiene or polyacrylate.

The layer of small hollow spheres 5 substantially fills up the depressions 2 and forms a thin layer in the area of the raised places 7 between the depressions 2. On the side of the layer of hollow spheres 5 opposite from the felting 1, a layer 8 of thermoplastic adhesive in a punctiform pattern is provided. Alternatively, the adhesive can be provided in a linear or grid pattern. The adhesive may be any suitable themoplastic adhesive, but is preferably a copolyamide, a polyvinyl acetate or a modified polyester.

The felting 1 had an initial weight per unit area of less than 105 g/m$^2$. After application of the hollow spheres 5 and the adhesive layer 8, the resulting felting had a weight per unit area of less than 230 g/m$^2$.

It is to be understood that the present invention has been described in terms of a preferred embodiment and that many other embodiments may fall within the spirit and scope of the following claims.

I hereby claim as my invention:

1. In an embossed felting having at least one depression in at least one of its surfaces the improvement in combination therewith comprising, a plurality of hollow spheres disposed in said depression such that said depression is at least partially filled in by said spheres, said spheres being bonded together and to said felting by means of a binding agent, said spheres and binding agent thereby defining a layer, said layer being provided with a plurality of interstitial spaces such that said layer is gas permeable.

2. The felting of claim 1 wherein said spheres wholly fill up said depression.

3. The felting of claim 2 wherein said layer extends over substantially all of said surface of said felting.

4. The felting of claim 3 additionally comprising a layer of thermoplastic adhesive adjacent to said layer of said spheres and said binding agent and opposite to said felting.

5. The felting of claim 4 wherein said layer of adhesive includes interstitial spaces such that it is as permeable.

6. The felting of claim 4 wherein said layer of adhesive forms a punctiform, linear or grid pattern.

7. The felting of claim 4 wherein said thermoplastic adhesive is a copolyamide, a polyvinyl acetate, or a modified polyester.

8. The felting of claim 1 wherein said spheres are thermoplastic.

9. The felting of claim 1 wherein said binding agent is a semi-solid plastic dispersion or plastic emulsion containing polyethylene, polyisobutylene, polyvinyl acetate, polyurethane, polybutadiene or polyacrylate.

10. The felting of claim 8 wherein said felting comprises polypropylene fibers.

11. The felting of claim 10 wherein the melting point of said spheres is lower than the melting point of said felting.

12. The felting of claim 8 wherein said spheres comprise a vinyl chloride copolymer.

* * * * *